US008448263B2

(12) United States Patent
Auer et al.

(10) Patent No.: US 8,448,263 B2
(45) Date of Patent: May 28, 2013

(54) WEARABLE STADIUM ARTICLE OF CLOTHING

(76) Inventors: Jack L. Auer, Huntington, WV (US); Freda Auer, Huntington, WV (US)

( * ) Notice: Subject to any disclaimer, the term of this patent is extended or adjusted under 35 U.S.C. 154(b) by 224 days.

(21) Appl. No.: 12/962,169

(22) Filed: Dec. 7, 2010

(65) Prior Publication Data

US 2011/0126339 A1 Jun. 2, 2011

Related U.S. Application Data

(63) Continuation-in-part of application No. 11/901,555, filed on Sep. 18, 2007, now abandoned.

(60) Provisional application No. 60/845,324, filed on Sep. 18, 2006.

(51) Int. Cl.
*A41D 3/02* (2006.01)

(52) U.S. Cl.
USPC ..... 2/69.5; 2/84

(58) Field of Classification Search
USPC ..... 2/93, 84, 82, 85, 69, 88, 102, 115, 2/108, 94–95, 114; 5/482, 486; 24/303
See application file for complete search history.

(56) References Cited

U.S. PATENT DOCUMENTS

| | | | | | |
|---|---|---|---|---|---|
| 536,383 | A | * | 3/1895 | Huyck | 2/69.5 |
| 906,551 | A | * | 12/1908 | Newman | 2/69.5 |
| 1,454,541 | A | * | 5/1923 | Falvey | 2/69 |
| 1,509,296 | A | * | 9/1924 | Hopewell | 2/88 |
| 1,603,501 | A | * | 10/1926 | Yenn | 2/84 |
| 1,610,799 | A | * | 12/1926 | Lack et al. | 2/69 |
| 1,641,039 | A | * | 8/1927 | La Beaud | 2/84 |
| 1,710,778 | A | * | 4/1929 | Luhn | 2/87 |
| 1,940,224 | A | * | 12/1933 | Munro | 2/69.5 |
| 2,072,644 | A | * | 3/1937 | McBee | 2/84 |
| D122,863 | S | * | 10/1940 | Doesburg | D2/719 |
| 2,462,269 | A | * | 2/1949 | Krempel | 2/84 |
| 2,667,641 | A | * | 2/1954 | Finnegan | 2/84 |
| 2,711,538 | A | * | 6/1955 | De Cordero | 2/84 |
| 2,967,306 | A | * | 1/1961 | Fabanich | 2/94 |
| 2,971,198 | A | * | 2/1961 | Tomich | 2/84 |
| 3,111,677 | A | * | 11/1963 | Artzt | 2/84 |
| 3,522,612 | A | * | 8/1970 | Palmer | 2/88 |
| 3,837,006 | A | * | 9/1974 | Laseman | 2/89 |
| D249,196 | S | * | 9/1978 | Wrightson | D2/719 |
| 4,142,264 | A | * | 3/1979 | Whiting | 5/482 |
| 4,217,662 | A | * | 8/1980 | Buchman | 2/69.5 |
| 4,240,159 | A | * | 12/1980 | Wrightson | 2/69 |
| 4,261,058 | A | * | 4/1981 | Buchman | 2/69.5 |
| D259,745 | S | * | 7/1981 | York et al. | D2/744 |

(Continued)

*Primary Examiner* — Richale Quinn
(74) *Attorney, Agent, or Firm* — James Ray & Assoc

(57) ABSTRACT

A cold-weather protective wearable article of clothing includes a substantially tubular main body portion. The main body portion having a continuous lower body portion and an upper body portion having a slit cut therein from a neck portion to an upper edge of said lower body portion. A first fastening mechanism is disposed along longitudinal edges of the upper body portion for closing such upper body portion into a tubular shape. A second fastening mechanism has a first portion thereof disposed along a shorter top edge adjacent proximal corners for holding the upper corners in place over the shoulders of a wearer. A second portion of the second fastening mechanism is disposed in at least two locations proximal midsection adjacent the longitudinal edges. A hood is one of formed integrally with and attached to the upper body portion adjacent the top edge of such upper body portion.

4 Claims, 4 Drawing Sheets

U.S. PATENT DOCUMENTS

| | | | | | |
|---|---|---|---|---|---|
| 4,310,925 | A | * | 1/1982 | York et al. | 2/69.5 |
| 4,752,971 | A | * | 6/1988 | Meserol | 2/88 |
| 5,099,526 | A | * | 3/1992 | Baena | 2/88 |
| 5,101,513 | A | * | 4/1992 | Bowers | 2/84 |
| 5,611,083 | A | * | 3/1997 | Arnold | 2/84 |
| 5,611,095 | A | * | 3/1997 | Schneider | 5/482 |
| 5,621,917 | A | * | 4/1997 | Howsden | 2/111 |
| 5,875,492 | A | * | 3/1999 | Moss | 2/93 |
| D429,059 | S | * | 8/2000 | Simmons | D2/825 |
| 6,275,993 | B1 | * | 8/2001 | McCarley | 2/84 |
| 6,760,921 | B1 | * | 7/2004 | Simmons | 2/84 |
| 6,851,127 | B1 | * | 2/2005 | Khan | 2/89 |
| 7,047,569 | B1 | * | 5/2006 | Mahon et al. | 2/88 |
| 7,178,185 | B1 | * | 2/2007 | Nattler | 5/482 |
| 2008/0066229 | A1 | * | 3/2008 | Auer et al. | 5/482 |

* cited by examiner

WEARABLE STADIUM ARTICLE OF CLOTHING

CROSS REFERENCE TO RELATED APPLICATION

This patent application is a continuation-in-part of our co-pending patent application Ser. No. 11/901,555 filed Sep. 18, 2007 and it is further related to and claims priority from U.S. Provisional Patent Application Ser. No. 60/845,324 filed Sep. 18, 2006.

FIELD OF THE INVENTION

The present invention relates, in general, to protective outer wear for primarily seated, standing or walking individuals and, more particularly, this invention relates to full-length tubular type article of clothing for protection from cold and wet weather of spectators at outdoor events.

BACKGROUND OF THE INVENTION

Prior to the conception and development of the present invention, spectators at outdoor events in cold weather would wrap blankets around part of their bodies to help keep warm. These tend to offer only partial coverage, and fall off when standing up. Also, blankets generally do not offer protection from rain and snow. Ponchos can provide head and upper body protection, but do not afford much protection for the legs from rain or cold.

Prior art patents have disclosed some partial answers to the problem identified. U.S. Pat. No. 536,383 illustrates a blanket-like sack for wearing in an outdoor lounge chair, but no rain or head protection is offered and the bottom is sealed making it very difficult for the wearer to stand up and walk around even a little. U.S. Pat. No. 4,142,264 discloses a bed comforter that is convertible for wearing in a chair. It is clearly for indoor use only with no head protection and no water repellence. Also, the bottom snaps must be undone before the wearer can get up and move around. U.S. Pat. No 4,217,662 similarly discloses a bed comforter that converts to a body wrap. It also is for indoor use only with no head protection, and uses a complex array of fasteners for various purposes such as adjustment of sleeve size.

SUMMARY OF THE INVENTION

The present invention provides a cold-weather protective wearable article of clothing which includes a tubular type main body of substantially rectangular blanket material with a first fastening means disposed along lateral edges of the main body for holding the blanket material in place once wrapped around a wearer's body. A second fastening means is built into a portion of the top edge for holding upper corners in place over the shoulders of a wearer. A hood is secured to the top edge of the rectangular blanket material, preferably in a manner that allows an outdoor wearable blanket of one size to fit users over a wide range of heights.

OBJECTS OF THE INVENTION

It is, therefore, one of the primary objects of the present invention to provide additional protection from cold and wet weather for spectators at outdoor events.

Another object of the present invention is to provide an extra layer of protection for individuals outside in cold weather that is easy to put on and take off.

Still another object of the present invention is to provide an inexpensive one-size-fits-all item of cold-weather outer wear.

A further object of the present invention is to provide a protective wearable article of clothing which allows the wearer to stand or walk.

Yet another object of the present invention is to provide both head and full body protection from the outdoor elements.

An additional object of the present invention is to provide weather protection for sports spectators while also displaying their team color and logos.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

BRIEF DESCRIPTION OF THE DRAWINGS

FIG. 5 is a side elevation view of a how a short person could wear the wearable blanket with the hood on.

FIG. 6 is a side elevation view of how a tall person could fit into the cold-weather protective wearable article of clothing with the hood on.

Figure 2:
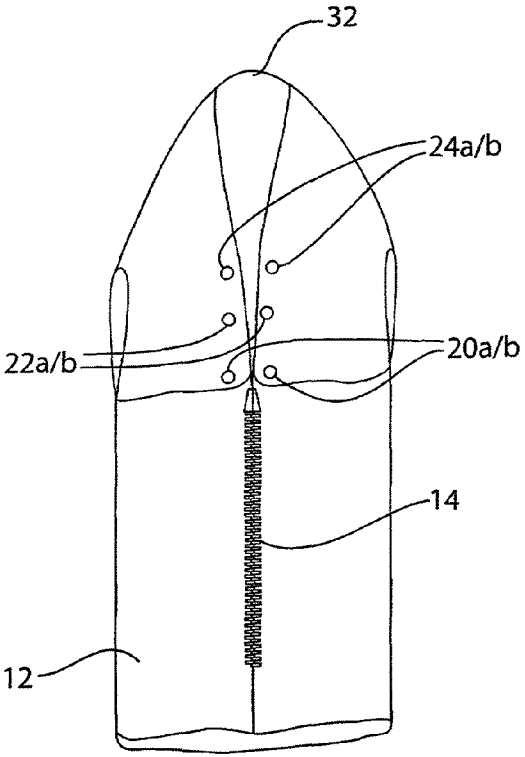
FIG. 2 is a frontal view of the cold-weather protective wearable article of clothing zipped and snapped together.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 1:
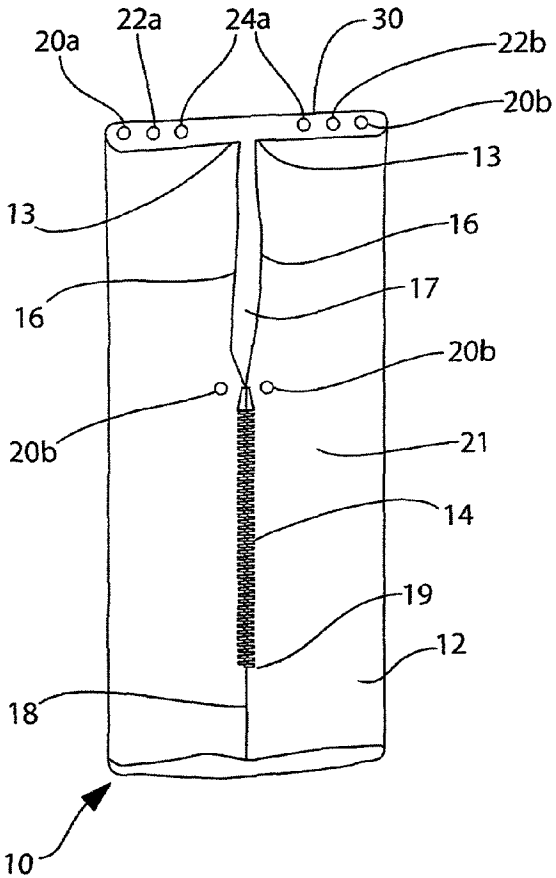
FIG. 1 is frontal view of the protective wearable article of clothing with all fasteners open.

Referring initially to FIG. 1, a front view shows the cold-weather protective wearable article of clothing, generally designated 10, with all of the fasteners in an open position. The cold-weather protective wearable article of clothing 10 includes a substantially tubular main body portion. The main body portion includes a continuous lower body portion 12 and an upper body portion 14 having a slit 17 cut therein from a neck portion defined by a top edge 13 to an upper edge 19 of such lower body portion 12.

A first fastening means, preferably a zipper 14. is disposed along longitudinal edges of the upper body portion 21 for closing such upper body portion 21 into a tubular shape.

A second fastening means, selected from hook and loop type and snaps 20, has a first portion disposed along shorter top edge proximal corners for holding upper corners in place over shoulders of a wearer.

A second portion of the second fastening means is disposed in at least two locations proximal midsection adjacent the longitudinal edges.

A hood 34 is one of formed integrally with and attached to said upper body portion adjacent the top edge 13 of the upper body portion.

The two mating sections of a zipper 14 are permanently attached along about the middle portion of each longitudinal edge 16. Two snap fastener halves 20*b* are installed adjacent the longitudinal edges about a third of the way down from the top edge 13. Near the top edge 13 are the mating halves of snaps 20*a*, 22*a/b*, and 24*a/b*.

FIG. 2 illustrates the cold-weather protective wearable article of clothing 10 as it would appear around the wearer. The zipper 14 is zipped shut up to about the half the longitudinal height. The halves of snap 20*a* along the top edge have been pulled down and fastened with mating halves 20*b* adjacent the longitudinal edges near the middle of the cold-weather protective wearable article of clothing 12.

Figure 3:
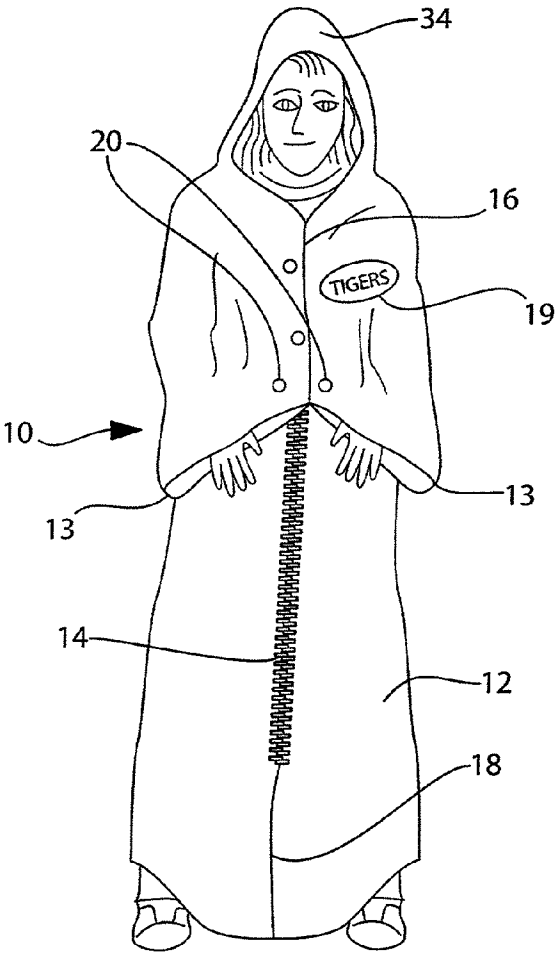
FIG. 3 is a frontal view of a person wearing the cold-weather protective wearable article of clothing with the hood in use.

FIG. 3 is a frontal view representing either embodiment depicting a person wearing the present invention with the hood, either 32 or 34, in use.

Figure 4:
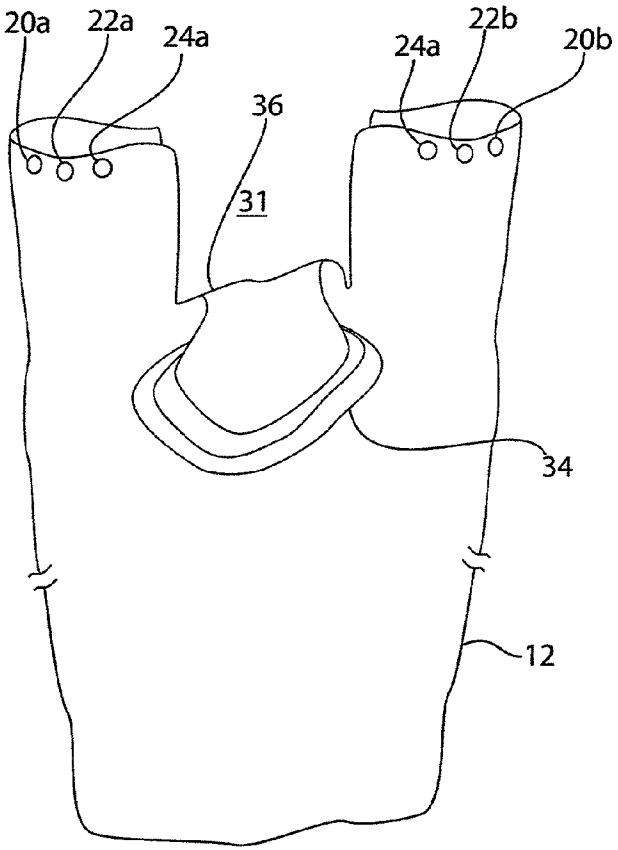
FIG. 4 is a rear view showing the hood attachment in a way allowing one size to fit a wide range of heights.

FIG. 4 depicts the preferred embodiment from a rear view. A notch 31 in the top edge of cold-weather protective wearable article of clothing 10 is cut forming a flap 36. Attached to this flap 36, permanently or removably, is a hood 34. The fastening means 20*a*, 22*a/b*, and 24*a/b* are disposed along the top front edge. These fasteners could be snaps, Velcro tabs, or buttons with snaps being preferred. The mating halves of fasteners 20*b* are not shown but a multiple number of each are attached in the front midsection adjacent the longitudinal edge. By selecting which of these front fasteners to use, the wearable blanket can be adjusted for users of variable heights.

Figure 5:
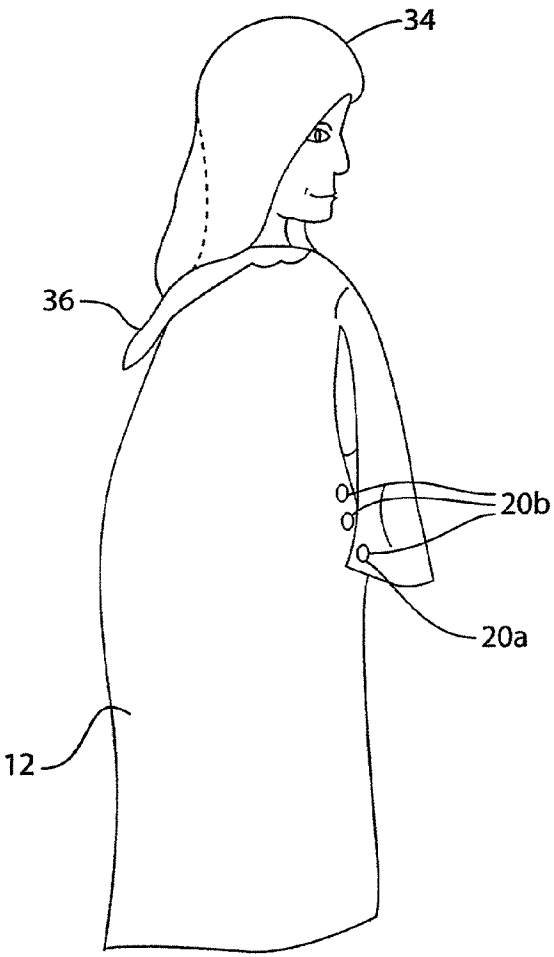

FIG. 5 illustrates a short person wearing the adjustable wearable blanket. The lowest of front fasteners 20*b* is used. With the hood 34 on, there is considerable slack in flap 36.

Figure 6:
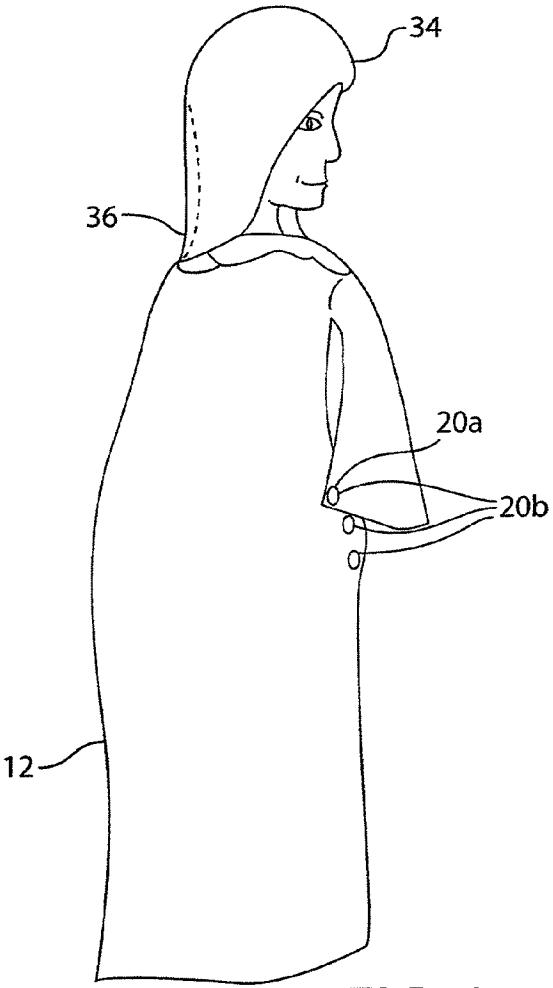

FIG. 6 illustrates a tall person also wearing the one-size-for-version. In this case, the highest of fasteners 20*b* is used, and with the hood 34 in use, there is little slack in flap 36.

Figure 7:
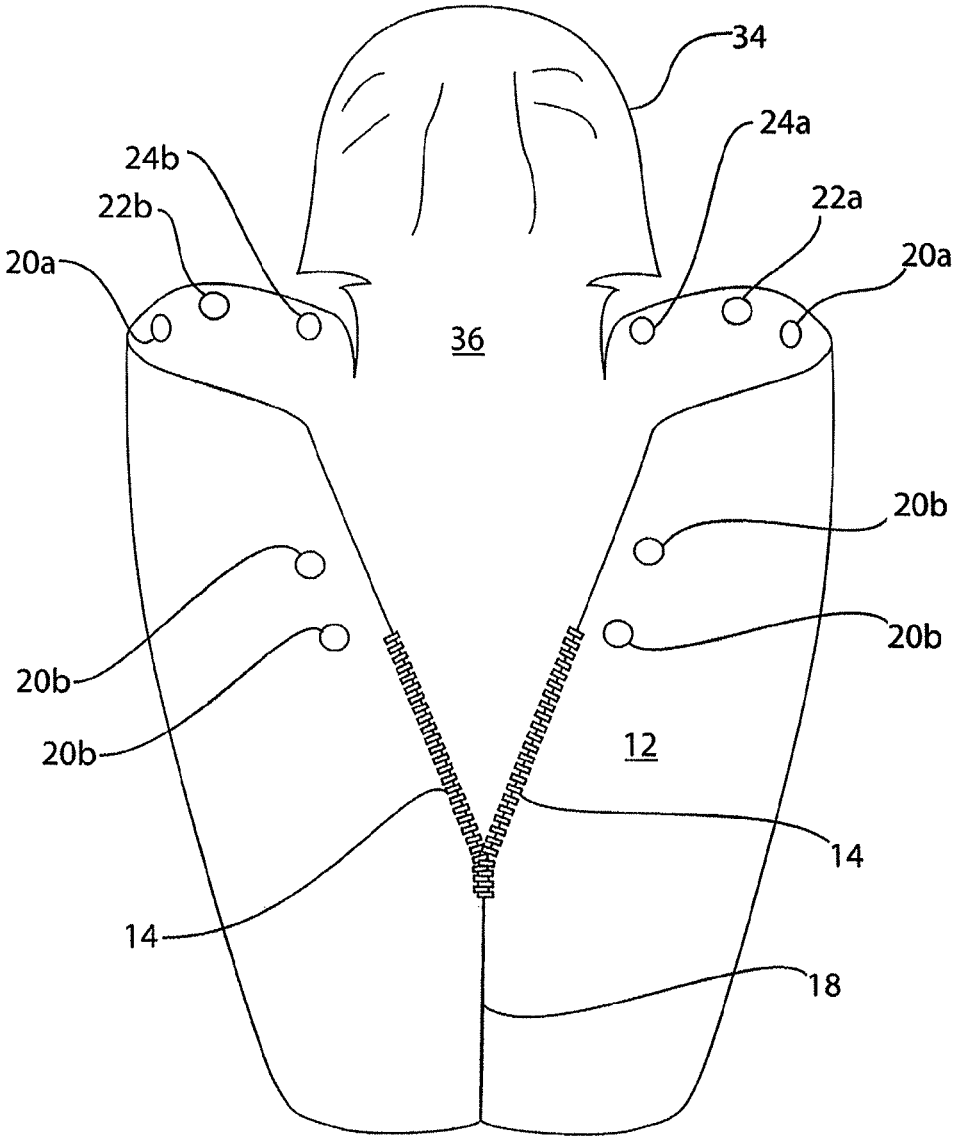
FIG. 7 is a front view of a presently preferred embodiment of the invention.

FIG. 7 illustrates an presently preferred embodiment in which the lateral edges of the front portion of the upper body part 12 has been folded around to the front and no more than 25% of the lateral edges have been sewn together or otherwise fixedly attached near the bottom 18. An additional portion of each lower lareral edge is fitted with a zipper 14, so that after a wearer steps into the tubular bottom portion, more of the front of the wearer can be covered A first (37) and second (38) notch are cut into a center portion of the top edge of the upper body portion in a spaced apart relation, such as to form the flap (36).

While a presently preferred and an alternative embodiment of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

We claim:

1. A cold-weather protective wearable article of clothing, said article of clothing comprising:

(a) a body including a generally tubular lower body portion and an upper body portion having a pair of longitudinal edges extending from a neck portion of said upper body portion to an upper edge of said lower body portion;

(b) a zipper disposed along longitudinal edges of said upper body portion and configured to selectively open or close said upper body portion;

(c) two groups of first fasteners disposed along a top edge of said upper body portion in a spaced apart relationship with each other for holding upper corners of said upper body portion in place over shoulders of a wearer, each of said two groups of fasteners having a plurality of fasteners;

(d) two groups of second fasteners, each disposed proximal midsection of the wearer and having a plurality of fasteners disposed along and spaced from a respective longitudinal edge of said upper body portion; and a first notch cut into said top edge of said upper body portion, a second notch cut in to said top edge of said upper body and spaced from said first notch, such that an area between said first and second notches forms a flap;

(e) a hood formed integrally with and/or attached to said upper body portion adjacent a top edge of said flap and mediates said two groups of first fasteners, said hood extending outwardly from said top edge of said flap; wherein said top edge of said flap has a smaller width than a lower edge of said hood.

2. The cold-weather protective wearable article of clothing of claim 1, wherein said flap forms a slack on a rear surface of said upper body portion when said article of closing is worn by the wearer and wherein said two groups of first and second fasteners and said flap are so configured that said slack is reduced in size when said article of clothing is worn by a tall wearer and is increased in size when said article of clothing is worn by a short wearer.

3. The cold-weather protective wearable article of clothing of claim 2, wherein a lowermost of said each group of said first fasteners mates with an uppermost of said each group of second fasteners when said article of clothing is worn by the tall wearer.

4. A cold-weather protective wearable article of clothing, said article of clothing comprising:

(a) a body including a generally tubular lower body portion and an upper body portion having a pair of longitudinal edges extending from a neck portion of said upper body portion to an upper edge of said lower body portion;

(b) one or more fasteners disposed along longitudinal edges of said upper body portion and configured to selectively open and close said upper body portion;

(c) two groups of first fasteners disposed along a top edge of said upper body portion in a spaced apart relationship with each other for holding upper corners of said upper body portion in place over shoulders of a wearer, each of said two groups of fasteners having a plurality of fasteners;

(d) two groups of second fasteners, each disposed proximal midsection of the wearer and having a plurality of fasteners disposed along and spaced from a respective longitudinal edge of said upper body portion; a first notch cut into said top edge of said upper body portion, a second notch cut in to said top edge of said upper body portion and spaced from said first notch, such that an area between said first and second notches forms a flap;

(e) said flap is located in a center portion of said top edge of said body portion and mediates said two groups of first fasteners; and (f) a hood being formed integrally with and/or attached to a top edge of said flap, wherein said top edge of said flap has a smaller width than a lower edge of said hood, and whereby said article of clothing is made adjustable to a wide range of heights of wearers by way of a slack formed by said flap on a rear surface of said upper body portion when said article of clothing is worn by the wearer and whereby said slack is reduced in size when said article of clothing is worn by a tall wearer and is increased in size when said article of clothing is worn by a short wearer.

* * * * *